US011578552B2

(12) United States Patent
Drenth et al.

(10) Patent No.: US 11,578,552 B2
(45) Date of Patent: Feb. 14, 2023

(54) REVERSE-CIRCULATION DRILLING ASSEMBLIES AND METHODS OF USING SAME

(71) Applicant: BLY IP INC., Salt Lake City, UT (US)

(72) Inventors: Christopher L. Drenth, Callander (CA); Anthony Lachance, Burlington (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 80 days.

(21) Appl. No.: 17/166,268

(22) Filed: Feb. 3, 2021

(65) Prior Publication Data

US 2021/0156213 A1 May 27, 2021

Related U.S. Application Data

(62) Division of application No. 16/486,216, filed as application No. PCT/US2018/017949 on Feb. 13, 2018, now Pat. No. 11,162,316.

(60) Provisional application No. 62/460,433, filed on Feb. 17, 2017.

(51) Int. Cl.
*E21B 31/20* (2006.01)
*E21B 34/14* (2006.01)

(52) U.S. Cl.
CPC ..... *E21B 31/20* (2013.01); *E21B 34/14* (2013.01); *E21B 2200/04* (2020.05)

(58) Field of Classification Search
CPC ..... E21B 2200/04; E21B 31/20; E21B 34/14
See application file for complete search history.

(56) References Cited

U.S. PATENT DOCUMENTS

| | | | | |
|---|---|---|---|---|
| 3,930,679 | A | 1/1976 | Anderson et al. | |
| 4,834,198 | A | 6/1989 | Thomson | |
| 2014/0054093 | A1 | 2/2014 | Drenth | |
| 2014/0174828 | A1 | 6/2014 | Muntz | |
| 2014/0174832 | A1* | 6/2014 | Drenth | E21B 31/20 175/235 |
| 2016/0017672 | A1 | 1/2016 | Back | |
| 2017/0051571 | A1* | 2/2017 | Drenth | E21B 25/00 |
| 2018/0171735 | A1 | 6/2018 | Salvador | |

* cited by examiner

*Primary Examiner* — Dany E Akakpo
(74) *Attorney, Agent, or Firm* — Ballard Spahr LLP

(57) ABSTRACT

A reverse-circulation drilling assembly having an overshot subassembly and a head subassembly. In the event retrieval of the drilling assembly by reverse-circulation fails, the drilling assembly can be retrieved using a secondary overshot.

19 Claims, 8 Drawing Sheets

REVERSE-CIRCULATION DRILLING ASSEMBLIES AND METHODS OF USING SAME

CROSS-REFERENCE TO RELATED PATENT APPLICATION

This application is a divisional of U.S. patent application Ser. No. 16/486,216, filed Aug. 15, 2019, which is a Section 371 national phase of International Patent Application No. PCT/US2018/017949, filed Feb. 13, 2018, claims priority to and the benefit of the filing date of U.S. Provisional Patent Application No. 62/460,433, filed Feb. 17, 2017. Each of the above-identified applications is incorporated herein by reference in its entirety.

FIELD

This application relates generally to reverse-circulation drilling assemblies and, more particularly, to reverse-circulation drilling assemblies comprising a head subassembly and an overshot subassembly that is coupled to the head assembly so that the head and overshot subassemblies are driven in a distal and a proximal direction by pressurized fluid within a borehole.

BACKGROUND

During conventional wireline drilling operations, a drilling operator is able to closely monitor the location of a head assembly within a borehole. However, the process for deploying and retrieving a wireline drilling assembly within the hole is time-consuming, and the wireline apparatus frequently encounters performance or maintenance issues that must be addressed before drilling operations can continue.

Reverse circulation drilling operations rely on fluid pressure to deploy and retrieve a drilling assembly within a borehole. However, existing reverse-circulation drilling assemblies have demonstrated poor performance and have created unsafe drilling conditions. Additionally, existing reverse-circulation drilling operations have relied on fluid pressure to deploy the latching mechanism of the head assembly, making it impossible for a drilling operator to closely track the location of a head assembly within a hole or to know when a head assembly is in a latched condition.

Accordingly, there is a need in the pertinent art for improved reverse circulation drilling assemblies that address deficiencies associated with conventional drilling assemblies.

SUMMARY

Described herein is a reverse-circulation drilling assembly having a longitudinal axis and comprising: an overshot subassembly having a proximal portion, a distal portion, and a check valve assembly positioned axially between the proximal and distal portions, wherein the distal portion comprises a latch assembly; and a head subassembly having a latch assembly, a valve assembly, and a proximal portion that defines a receptacle configured to receive a portion of the distal portion of the overshot subassembly, wherein the proximal portion of the head subassembly further comprises a latch retracting case that is configured for axial movement relative to the longitudinal axis to effect movement of the latch assembly about and between a retracted position and a deployed position in which the latch assembly engages an inner surface of a drill string, wherein the latch retracting case is coupled to the valve assembly and configured to effect movement of the valve assembly about and between a closed position and an open position that permits fluid flow through the head subassembly, wherein the latch assembly of the overshot subassembly is configured for movement from a retracted position to a deployed position to engage the proximal portion of the head subassembly when the distal portion of the overshot subassembly is received within the receptacle, and wherein the check valve assembly of the overshot subassembly is biased to the closed position and configured to move from the closed position to the open position when the latch assembly of the head subassembly is moved from the retracted position to the deployed position.

Also described herein is a method of using the reverse-circulation drilling assembly of any one of the preceding aspects, the drilling assembly positioned within a borehole, the method comprising: positioning the distal portion of the overshot subassembly within the receptacle of the head subassembly; deploying the latch assembly of the overshot subassembly to engage the head subassembly; using pressurized fluid to direct movement of the drilling assembly in a distal direction; continuing to direct movement of the drilling assembly in the distal direction until the latch assembly of the head subassembly is positioned in the deployed position and the check valve assembly of the overshot subassembly and the valve assembly of the head subassembly are positioned in the open position; and using pressurized fluid to direct movement of the drilling assembly in a proximal direction.

Further described herein is a reverse-circulation drilling assembly having a longitudinal axis and comprising: an overshot subassembly having: a proximal body portion defining a fluid port; a distal body portion having a wall with an inner surface and an outer surface, the inner surface of the distal body portion defining a central bore, the wall of the distal body portion defining a fluid port that extends from the inner surface to the outer surface; a valve assembly positioned in fluid communication with the fluid port of the proximal body portion and configured for axial movement about and between a closed position and an open position, wherein in the closed position, the valve assembly prevents fluid flow between the fluid port of the proximal body portion and the fluid port of the distal body portion, and wherein in the open position, the valve assembly permits fluid flow between the fluid port of the proximal body portion and the fluid port of the distal body portion, wherein the valve assembly is biased to the closed position; a driving element at least partially received within the central bore of the distal body portion, wherein the driving element has an outer surface; and an overshot latching assembly coupled to the distal body portion and configured for movement about and between a retracted position and a deployed position, wherein axial advancement of the distal body portion in a proximal direction relative to the driving element is configured to move the overshot latching assembly from its deployed position toward its retracted position; and a head subassembly having: a retracting case having an inner surface, a proximal portion that defines a central bore and a groove, and a distal portion that defines a driving surface, wherein the central bore is configured to receive a portion of the distal body portion of the overshot subassembly, and wherein the groove of the proximal portion of the body is configured to receive a portion of the overshot latching assembly when the overshot latching assembly is in the deployed position; a latch body having a central bore, a proximal portion that receives the distal portion of the retracting case, and a distal portion that defines at least one fluid port positioned in fluid communication with the central bore; a head latching assembly coupled to the latch body and configured for movement about and between a retracted position and a deployed position, a fluid control element coupled to the retracting case and positioned within the central bore of the latch body, wherein the fluid control element is configured for axial movement about and between a closed position and an open position, wherein in the closed position, the fluid control element prevents fluid flow between the proximal and distal portions of the latch body, and wherein in the open position, the fluid control element permits fluid flow between the proximal and distal portions of the latch body, wherein axial movement of the retracting case in a distal direction relative to the latch body is configured to move the head latching assembly from the retracted position toward the deployed position and to move the fluid control element from the closed position toward the open position.

Also described herein is an overshot assembly comprising: a proximal portion defining a receptacle; and a distal portion comprising a latch subassembly that is configured for deployment to engage a proximal portion of a head subassembly, wherein the receptacle of the proximal portion of the overshot assembly is configured to complementarily receive a latch subassembly of a distal portion of a second overshot assembly.

Further described herein is an overshot system comprising: a first overshot assembly comprising: a proximal portion defining a receptacle; and a distal portion comprising a latch subassembly that is configured for deployment to engage a proximal portion of a head assembly; and a second overshot assembly comprising: a proximal portion comprising a cable swivel assembly; and a distal portion that is configured for complementary receipt within the receptacle of the proximal portion of the first overshot subassembly, and wherein the distal portion of the second overshot assembly comprises a latch subassembly that is configured for deployment to engage the proximal portion of the first overshot assembly.

BRIEF DESCRIPTION OF THE DRAWINGS

These and other aspects of the invention will become more apparent in the detailed description in which reference is made to the appended drawings wherein:

FIG. 4A depicts an overshot subassembly that is spaced proximally from the head subassembly (prior to insertion of the overshot subassembly into the receptacle of the head subassembly). FIGS. 4B-4E depict the drilling assembly after the overshot subassembly is latched to the head subassembly as disclosed herein. FIG. 4B depicts the drilling assembly as the drilling assembly is pumped into the borehole in a distal direction. FIG. 4C depicts the drilling assembly in a landed condition. FIG. 4D depicts the drilling assembly in a latched condition in which the head subassembly is latched to a drill string. FIG. 4E depicts the drilling assembly as the drilling assembly is pumped out of the borehole in a proximal direction.

FIG. 7A depicts an overshot subassembly that is spaced proximally from the head subassembly (prior to insertion of the overshot subassembly into the receptacle of the head subassembly). FIGS. 7B-7E depict the drilling assembly after the overshot subassembly is latched to the head subassembly as disclosed herein. FIG. 7B depicts the drilling assembly as the drilling assembly is pumped into the borehole in a distal direction. FIG. 7C depicts the drilling assembly in a landed condition. FIG. 7D depicts the drilling assembly in a latched condition in which the head subassembly is latched to a drill string. FIG. 7E depicts the drilling assembly as the drilling assembly is pumped out of the borehole in a proximal direction.

DETAILED DESCRIPTION

Figure 1:
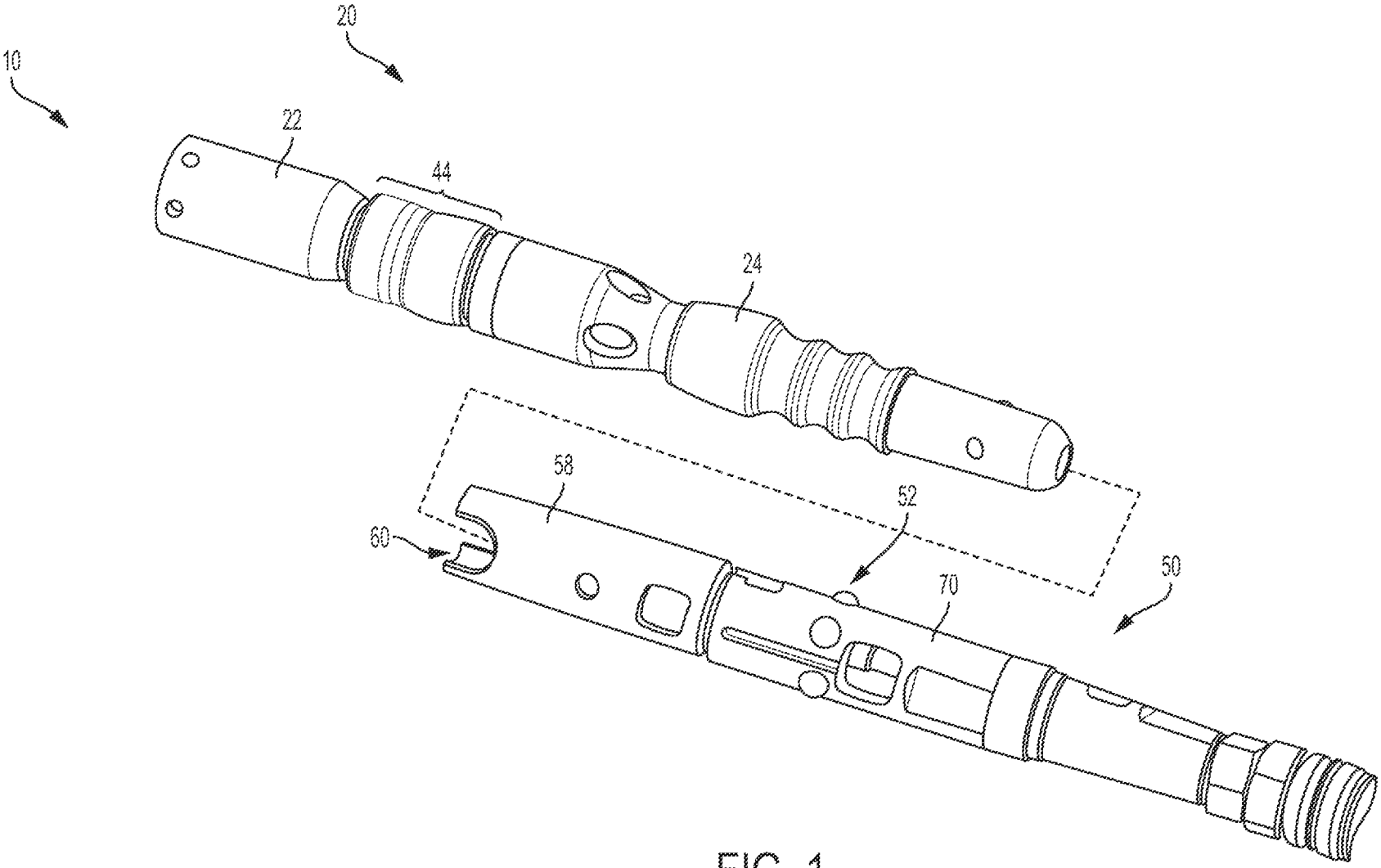
FIG. 1 is a perspective view of an exemplary drilling assembly having an overshot subassembly and a head subassembly as disclosed herein. As shown, the overshot subassembly can define a receptacle (socket) for receiving a secondary overshot, and the head subassembly can define a receptacle (socket) for receiving a distal portion of the overshot subassembly.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a latch member" can include two or more such latch members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the term "proximal" refers to a direction toward the surface of a formation (where a drill rig can be located), whereas the term "distal" refers to a direction toward the bottom of a drill hole, moving away from the surface of the formation. When the terms "proximal" and "distal" are used to describe system components, it is expected that during normal use of those components, the "proximal" components will be positioned proximally (closer to the surface of the formation) relative to the "distal" components and the "distal" components will be positioned distally (closer to the bottom of a drill hole) relative to the "proximal" components.

Described herein with reference to FIGS. 1-8 is a drilling assembly 10 configured for deployment and retrieval within a borehole using a reverse-circulation process. The drilling assembly 10 can be provided as a component of a larger drilling system. It is contemplated that the disclosed drilling assembly 10 can be used in either underground or surface drilling applications. It is further contemplated that the disclosed drilling assembly can be used in up-hole, down-hole, or flat/horizontal drilling operations. In exemplary aspects, the drilling system can comprise a core barrel as is known in art.

In exemplary aspects, and as further disclosed herein, the reverse-circulation drilling assembly 10 can have a longitudinal axis and comprise an overshot subassembly 20 and a head subassembly 50. The overshot subassembly 20 can be configured to securely engage the head subassembly 50 such that the overshot subassembly and the head subassembly are deployed and retrieved together. Optionally, the overshot subassembly 20 can engage the head subassembly prior to insertion or advancement of the drilling assembly 10 within the borehole. Alternatively, it is contemplated that the head subassembly 50 and the overshot subassembly 20 can be deployed separately within the hole, with the overshot subassembly engaging the head subassembly within the hole. In exemplary aspects, when the disclosed reverse-circulation drilling assembly 10 is configured for use in down-hole or flat/horizontal drilling operations, the reverse-circulation drilling assembly does not comprise a holdback brake. However, when the disclosed reverse-circulation drilling assembly 10 is configured for use in up-hole drilling operations, the overshot subassembly 20 can comprise a holdback brake as is known in the art.

The Overshot Subassembly

In exemplary aspects, the overshot subassembly 20 can have a proximal portion 22, a distal portion 24, and a check valve assembly 28 positioned axially between the proximal and distal portions. In these aspects, the distal portion 24 of the overshot subassembly can comprise a latch assembly 26. Optionally, it is contemplated that the latch assembly 26 can comprise at least one latch member 27 (optionally, a plurality of latch members). It is contemplated that each latch member 27 of the at least one latch member can be at least one of a ball, a roller, a cylinder, a cam-shaped element, and the like. In use, the latching assembly 26 can be configured for movement about and between a retracted position and a deployed position. As further disclosed herein, when the latching assembly 26 comprises at least one latch member 27, each latch member can be driven radially outwardly to position the latch assembly in the deployed position. Although a latching assembly 26 comprising latch members 27 is depicted in the Figures, it is contemplated that any conventional latch mechanism can be used to effect locking engagement between the overshot subassembly 20 and the head subassembly 50.

In one aspect, the overshot subassembly 20 can further comprise a valve seat 40 positioned axially between the proximal and distal portions 22, 24 of the overshot subassembly. In this aspect, it is contemplated that the valve seat 40 can define a central bore 42. In another aspect, the check valve assembly 28 can comprise a ball 30 that is at least partially received within the central bore 42 of the valve seat 40. In this aspect, the check valve assembly 28 can further comprise a spring 32 that is configured to bias the ball 30 in a proximal direction toward the closed position, in which the ball can block fluid flow through the central bore 42 of the valve seat 40. In further aspects, the check valve assembly 28 can further comprise a bushing 34 that is positioned axially between the valve seat 40 and the spring 32. In these aspects, in the closed position, the ball 30 can form a fluid-tight seal with the bushing 34, and in the open position, the ball can be positioned distally of the bushing to permit fluid flow between the ball and the bushing (and into the central bore 42 of the valve seat 40). As further disclosed herein, it is contemplated that the check valve assembly 28 can be biased to the closed position.

Figure 2:
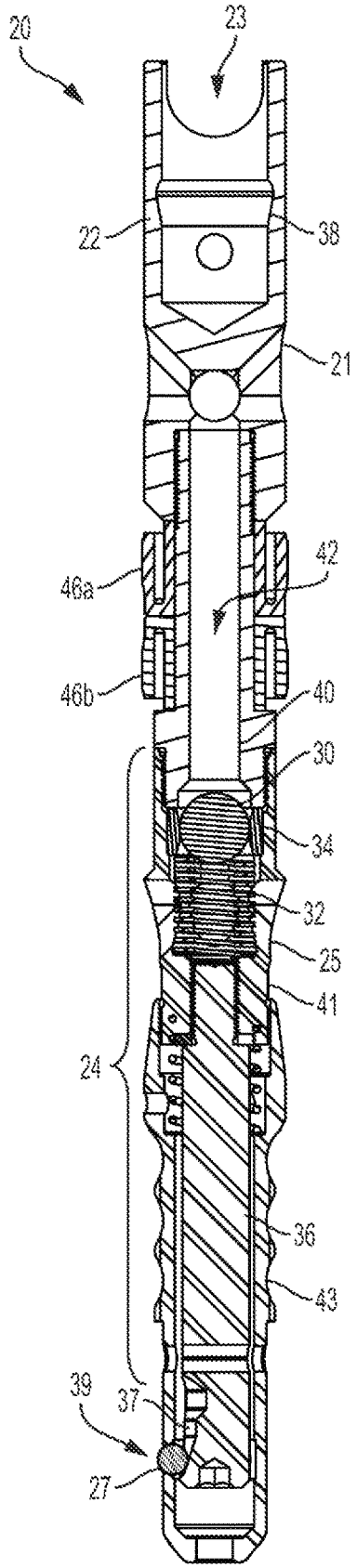
FIG. 2 is an isolated cross-sectional side view of an exemplary overshot subassembly having a proximal receptacle and a distal latching assembly as disclosed herein.
Figure 3:
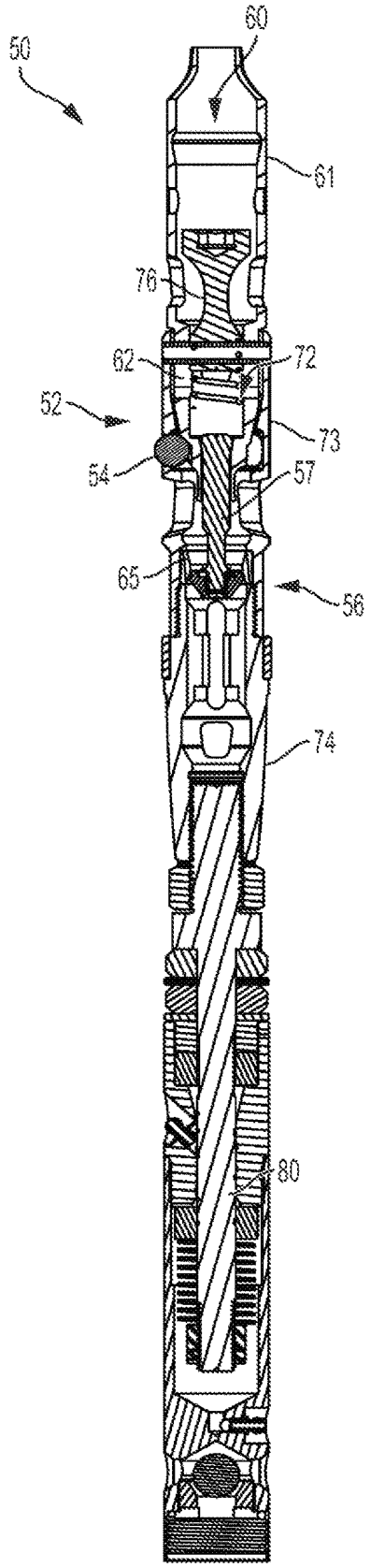
FIG. 3 is an isolated cross-sectional side view of an exemplary head subassembly having a proximal receptacle as disclosed herein.
Figures 4A, 4B, 4C, 4D, 4E:
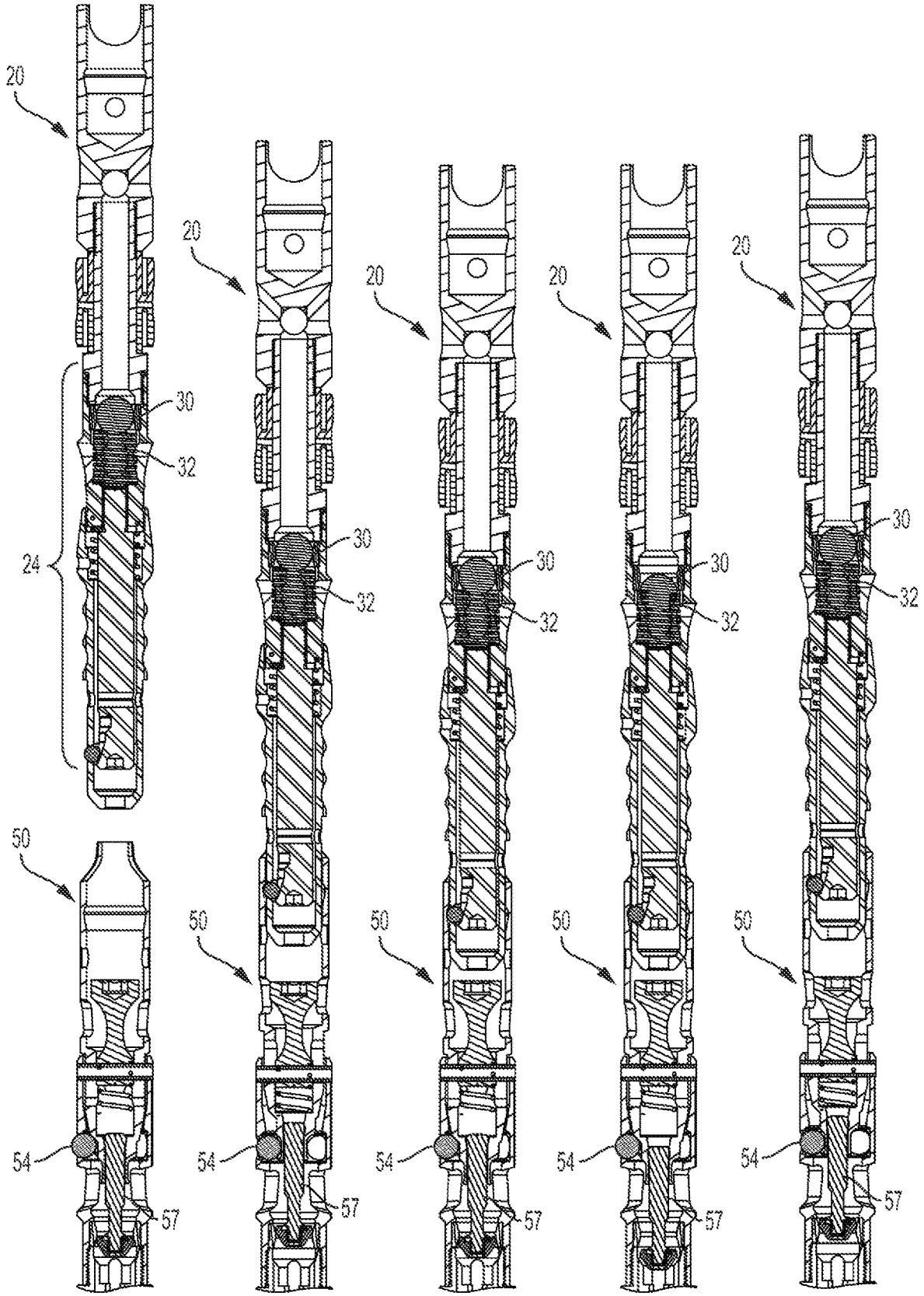
FIGS. 4A-4E depict the sequential advancement and retrieval of a drilling assembly using a reverse-circulation process as disclosed herein.
Figure 6:
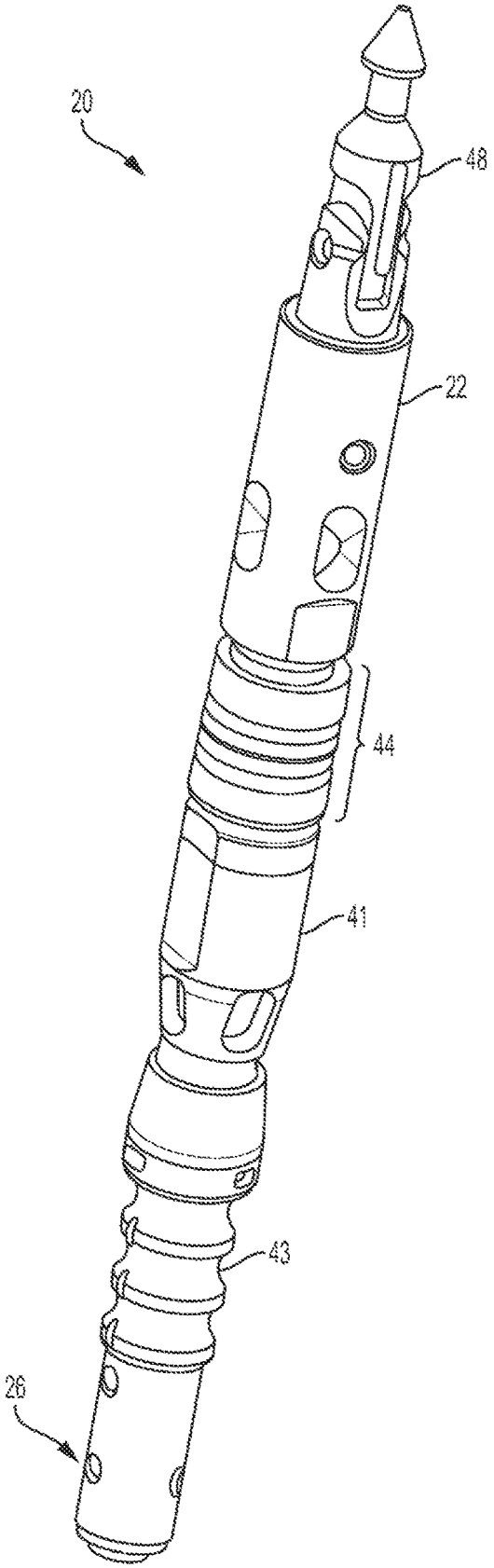
FIG. 6 is a perspective view of an exemplary overshot subassembly having a spearhead received within the receptacle of the overshot subassembly.

In exemplary aspects, and with reference to FIGS. 1-2 and 6, the overshot subassembly 20 can comprise a seal assembly 44 that circumferentially surrounds an outer surface of the valve seat 40 and is axially positioned between the proximal and distal portions 22, 24 of the overshot subassembly. In these aspects, it is contemplated that the seal assembly 44 can comprise first and second lip seals **46*a*, 46*b* that are positioned adjacent each other and oriented in opposition to one another to permit axial movement of the drilling assembly by fluid flow in both distal and proximal directions. For example, as shown in FIG. 2, it is contemplated that the first lip seal 46*a* can be oriented such that its lip (e.g., circumferential lip) can be engaged and expanded radially by fluid flow in a proximal direction (for example, during pump-in), while the second lip seal 46*b*** can be oriented such that its lip (e.g., circumferential lip) can be engaged and expanded radially by fluid flow in a distal direction (for example, during pump-out by reverse-circulation).

Figure 5:
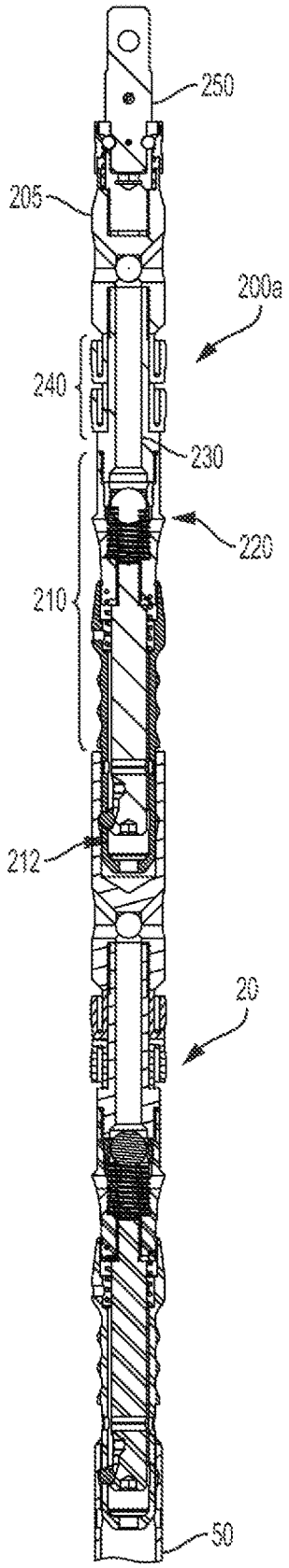
FIG. 5 is a side cross-sectional view of an overshot system including an overshot subassembly as depicted in FIGS. 4A-4E and a secondary overshot that is latched to the overshot subassembly to retrieve a drilling assembly as disclosed herein.
Figures 7A, 7B, 7C, 7D, 7E:
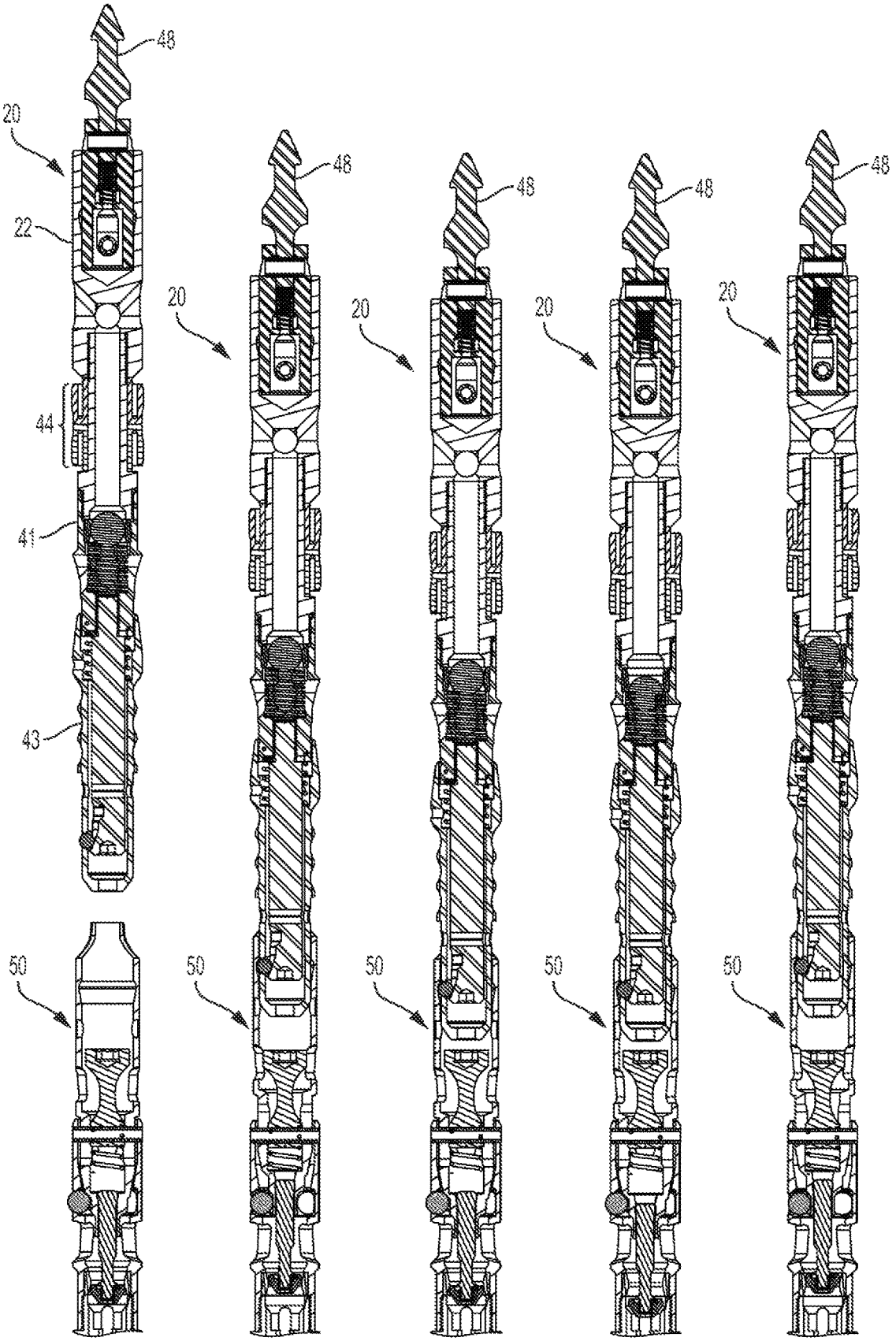
FIGS. 7A-7E depict the sequential advancement and retrieval of a drilling assembly using a reverse-circulation process as disclosed herein.
Figure 8:
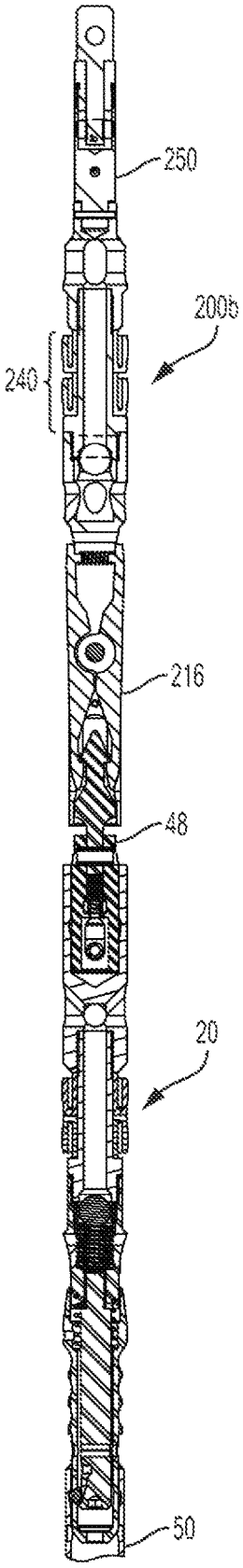
FIG. 8 is a side cross-sectional view of an overshot system including an overshot subassembly as depicted in FIGS. 7A-7E and a secondary overshot having lifting dogs that engage a spearhead of the overshot subassembly to retrieve a drilling assembly as disclosed herein.

In exemplary aspects, and with reference to FIGS. 1-2 and 4A-8, the proximal portion 22 of the overshot subassembly can define a receptacle 23 that is configured to receive a portion of an overshot. For example, in some optional aspects and as depicted in FIG. 5, the receptacle 23 of the proximal portion 22 of the overshot subassembly 20 can be configured to complementarily receive a latch subassembly of a distal portion of a second overshot assembly. In these aspects, an inner surface of the receptacle 23 can optionally define a groove 38 (optionally, a circumferential groove) that is configured to receive a portion of the latch assembly when the latch assembly is in the deployed position. Alternatively, in other optional aspects and as depicted in FIGS. 7A-8, the receptacle 23 can be configured to receive and engage a spearhead assembly 48 as is known in the art.

In exemplary aspects, and with reference to FIG. 2, the proximal and distal portions 22, 24 of the overshot subassembly 20 can have respective walls that define respective fluid ports 21, 25 that are positioned in fluid communication with the central bore 42 of the valve seat. The fluid port 25 of the distal portion 24 of the overshot subassembly 20 can extend from an outer surface to an inner surface of the wall of the distal portion. In use, when the check valve assembly 28 is positioned in the closed position, the check valve assembly can prevent fluid flow between the fluid port 21 of the proximal portion 22 and the fluid port 25 of the distal portion 24, and when the check valve assembly is positioned in the open position, the check valve assembly can permit fluid flow between the fluid port of the proximal portion and the fluid port of the distal portion.

In use, it is contemplated that the check valve assembly 28 can be configured to move to the open position only upon landing of the drilling assembly (e.g., a stop of axial movement), at which point there is sufficient force (e.g., fluid pressure) against the check valve assembly (e.g., ball 30) to overcome the biasing force supplied by spring 32. Thus, the movement of the check valve assembly 28 from the closed position to the open position and the corresponding change in pressure within the overshot subassembly 20 can provide an indication that the drilling assembly has landed within the borehole.

In further exemplary aspects, the overshot subassembly 20 can comprise a driving element 36 that is at least partially received within a central bore 35 defined by the distal portion 24 of the overshot subassembly. Optionally, in these aspects, the driving element 36 can have an outer driving surface 37 that is configured to engage the latch assembly 26 and effect movement of the latch assembly about and between the deployed and retracted positions. In further aspects, the distal portion 24 of the overshot subassembly 20 can define at least one radial opening 39 (optionally, a plurality of radial openings) that are configured to receive portions of the latch assembly 26 when the latch assembly is driven to the deployed position, thereby permitting engagement between the latch assembly and the head subassembly 50. Optionally, in exemplary aspects, it is contemplated that the distal portion 24 of the overshot subassembly 20 can comprise a first body portion 41 that defines a seat for spring 32 and that is coupled to the driving element 36. In these aspects, the distal portion 24 of the overshot subassembly 20 can further comprise a sleeve 43 that is positioned distal of the first body portion 41 and that defines the central bore, which receives a portion of the first body portion 41. In use, it is contemplated that axial advancement of the distal portion 24 (e.g., the sleeve 43) in a proximal direction relative to the driving element 36 can be configured to move the latching assembly 26 from its deployed position toward its retracted position. It is further contemplated that the sleeve 43 can be configured for axial advancement relative to the driving element 36 (e.g., proximal or distal axial advancement), and the driving element can be configured for axial movement but not rotational movement relative to the longitudinal axis of the drilling assembly.

As the sleeve 43 moves in a proximal direction relative to the driving element 36, the sleeve 43 drives movement of the latching assembly 26 in a proximal direction until the latching assembly is positioned at an axial position where the driving element 36 is shaped to accommodate the latching assembly within the central bore of the sleeve. As one of skill in the art will appreciate, unlike conventional latching mechanisms for drilling applications in which axial movement of a driving member positioned within a body is tied to axial movement of the body (i.e., axial movement of the body results in a corresponding axial movement of the driving member), the disclosed overshot subassembly permits independent axial movement of the driving member 36 and the sleeve 43.

Optionally, as shown in FIGS. 1-2 and 4A-8, it is contemplated that the outer surface of the sleeve 43 can define a grip portion that is configured for complementary engagement by at least one hand of an operator or user of the overshot subassembly 20. Optionally, in exemplary aspects, the grip portion can comprise a plurality of radially projecting features that are spaced apart relative to the longitudinal axis of the drilling assembly, with the axial spaces between sequential radially projecting features being configured to receive at least a portion of one or more fingers of a user of the overshot subassembly 20. In use, it is contemplated that the grip portion can allow a user of the overshot assembly to use his or her hands to securely engage the sleeve 43 and effect twisting movement or proximal axial movement (optionally, twisting movement and proximal axial movement) of the sleeve relative to the driving element 36 to thereby overcome biasing forces and move the latching assembly 26 from its deployed position to its retracted position as further disclosed herein.

In use, when the sleeve is axially advanced in a proximal direction relative to the driving element 36, the surfaces of the sleeve 43 that define the at least one distal radial opening 39 can contact the at least one latch member 27 and apply an axial force to the at least one latch member until the at least one latch member is positioned at an axial location in which it can be received within the central bore of the spindle.

In one aspect, a distal portion of the driving element 36 can have a wedge portion. In this aspect, the wedge portion of the driving element 36 can define the first driving surface 37. In operation, the latching assembly 26 can be positioned in engagement with the first driving surface 37 when the latching assembly is in the deployed position, and upon axial advancement of the sleeve 43 relative to the longitudinal axis, a proximal portion of the first driving surface can define a recess that is configured to receive the latching assembly and permit radial movement of the latching assembly toward the retracted position. Optionally, it is contemplated that the wedge portion can be tapered inwardly moving in a proximal direction such that the latching assembly 26 is gradually and progressively received within the central bore of the sleeve 43 as the sleeve and the latching assembly are axially advanced in a proximal direction.

Upon movement of the sleeve 43 in a distal direction substantially parallel to the longitudinal axis, it is contemplated that the first driving surface 37 of the wedge portion can be configured to wedge the at least one latch member 27 between the head subassembly and the first driving surface.

Thus, it is contemplated that the inner surface of the receptacle 60 of the head subassembly 50 as further disclosed herein can be configured for secure engagement with the at least one latch member 27 of the overshot subassembly 20 when the at least one latch member is positioned in the deployed position. Upon secure engagement between the at least one latch member 27 of the overshot subassembly 20 and the inner surface of the receptacle 60 of the head subassembly 50 as described herein, it is contemplated that the head subassembly 50 can be operatively coupled to the overshot subassembly such that movement of the overshot subassembly results in a corresponding movement of the head subassembly. Optionally, it is contemplated that the at least one latch member 27 of the overshot subassembly 20 can securely engage the inner surface of the receptacle 60 of the head subassembly 50 such that the overshot subassembly cannot rotate relative to the head subassembly.

In additional aspects, when the at least one latch member 27 of the overshot subassembly 20 is positioned in the retracted position, it is contemplated that the at least one latch member and the outer surface of the sleeve 43 can define an outer diameter of the distal portion of the overshot subassembly 20 that is less than the inner diameter of the receptacle 60 of the head subassembly 50.

In further aspects, and as further disclosed herein, it is contemplated that the latching assembly 26 (e.g., the at least one latch member 27) can be biased toward the deployed position. In exemplary aspects, the at least one latch member 27 can be spring-loaded toward the deployed position. In these aspects, it is contemplated that the driving element 36 can be spring-loaded toward an axial position in which the at least one latch member 27 is urged toward the deployed position (by wedge portion).

Optionally, in exemplary aspects, and as shown in FIGS. 8A and 9A, the wall 32 of the distal body portion 30 and the spindle 70 can define respective transverse bores 39, 79 that can be aligned when the latch assembly is in the deployed position. In these aspects, it is contemplated that when the latch assembly is in the deployed position, a locking pin (not shown) can be inserted through the aligned transverse bores 39, 79 of the distal body portion 30 and the spindle 70 to restrict axial movement of the distal body portion relative to the spindle and thereby retain the latch assembly in the deployed position. It is further contemplated that the head assembly 300 can define its own transverse bores (e.g., two transverse bores on opposing sides of the head assembly) that are positioned to align with the transverse bores of the distal body portion 30 and the spindle 70 when the latch assembly is positioned in engagement with the head assembly as further disclosed herein (e.g., when the latch assembly engages a groove within the head assembly). In use, it is contemplated that the locking pin can pass through the aligned transverse bores of the distal body portion 30, the spindle 70, and the head assembly 300 to lock the relative axial positions of these components. It is further contemplated that the locking pin can function as a safety feature during handling of the overshot and mated head assembly (including an inner tube) outside of the drilled hole. During manual or automated handling outside of the hole, the locking pin can be configured to prevent the accidental release of the head assembly in response to sufficient inertia, bumping, or impact.

As further disclosed herein, in exemplary aspects, it is contemplated that the sleeve 43 can be configured for (1) twisting movement relative to the driving element 36 and then (2) axial movement relative to the driving element to overcome a spring-biasing force (that drives the driving element into an axial position in which the latching assembly is forced to the deployed position), thereby axially displacing the latching assembly such that it can be received in the retracted position. It is further contemplated that the recessed portion of the driving element 36 can be eliminated and optionally modified such that the driving element has a substantially consistent outer diameter within the sleeve 43. It is still further contemplated that, by providing more effective axial displacement of the sleeve 43 relative to the driving element, the grip portion of the outer surface of the sleeve disclosed herein can allow for use of a stronger and more reliable spring to bias the latching assembly to the deployed position, thereby making the overshot subassembly safer and more reliable.

It is still further contemplated that the milling of pathways and wedge-ramps in the driving element 36 for engagement with the latching members 27 can provide increased strength in comparison to turned conical wedges and other known approaches for producing driving surfaces.

The Head Subassembly

In exemplary aspects, the head subassembly 50 can have a latch assembly 52, a valve assembly 56 (fluid control element), and a proximal portion 58 that defines a receptacle 60 configured to receive a portion of the distal portion 24 of the overshot subassembly 20 as further disclosed herein. Optionally, in these aspects, the proximal portion 58 of the head subassembly 50 can further comprise a latch retracting case 62 that is configured for axial movement relative to the longitudinal axis to effect movement of the latch assembly 52 about and between a retracted position and a deployed position in which the latch assembly engages an inner surface of a drill string. The latch retracting case 62 can be coupled to the valve assembly 56 and configured to effect movement of the valve assembly about and between a closed position and an open position that permits fluid flow through the head subassembly 50. As further disclosed herein, the latch assembly 26 of the overshot subassembly 20 can be configured for movement from a retracted position to a deployed position to engage the proximal portion 58 of the head subassembly 50 when the distal portion 24 of the overshot subassembly is received within the receptacle. In exemplary aspects, the latch assembly 52 of the head subassembly 50 can comprise at least one latch member 54 (e.g., a plurality of latch members). It is contemplated that each latch member 54 of the at least one latch member can be at least one of a ball, a roller, a cylinder, a cam-shaped element, and the like. In use, the latching assembly 52 can be configured for movement about and between a retracted position and a deployed position. As further disclosed herein, when the latching assembly 52 comprises at least one latch member 54, each latch member can be driven radially outwardly to position the latch assembly in the deployed position. Although a latching assembly 52 comprising latch members 54 is depicted in the Figures, it is contemplated that any conventional latch mechanism can be used to effect locking engagement between the head subassembly 50 and the inner surface of a drill string. In exemplary aspects, and as further disclosed herein, the receptacle 60 of the proximal portion 58 of the head subassembly 50 can define a groove 61 that is configured to receive a portion of the latch assembly 52 (e.g., latch members 54) when the latch assembly is in the deployed position. In one aspect, the latch retracting case 62 of the head subassembly 50 can be configured to effect movement of the valve assembly 56 to the open position when the latch assembly 52 of the head subassembly is moved from the retracted position to the deployed position. As further disclosed herein, the check valve assembly 28 of the overshot subassembly 20 can be biased to the closed position and configured to move from the closed position to the open position when the drilling assembly 10 has landed within the borehole. Shortly after landing of the drilling assembly 10, the latch retracting case 62 can be configured to effect movement of the latch assembly 52 to the deployed (latched) position, at which point the valve assembly 56 is moved to the open position. In combination, and as further disclosed herein, it is contemplated that the check valve assembly 28 of the overshot subassembly 20 and the valve assembly 56 of the head subassembly 50 can cooperate to provide an indication of landing and then latching of the drilling assembly 10.

In exemplary aspects, the head subassembly 50 can comprise a latch body 70 that defines a central bore 72. In these aspects, the latch assembly 52 of the head subassembly 50 can be positioned within the latch body 70. In further aspects, the latch body 70 can comprise a distal end portion 74. In these aspects, it is contemplated that the head subassembly 50 can further comprise a spindle 80 secured to the distal end portion 74 of the latch body and a spindle bushing and inner tube cap that enclose the spindle. Optionally, the spindle 80 does not comprise a central axial bore. However, if a spindle 80 is provided with a central axial bore, it is contemplated that the head subassembly 50 can further comprise a check valve assembly positioned in communication with the central bore of the spindle.

In exemplary aspects, the retracting case 62 can have an inner surface, a proximal portion that defines the receptacle 60 (e.g., a central bore and a groove 61), and a distal portion that defines a driving surface. In further exemplary aspects, the latch body 70 can have a central bore 72, a proximal portion 73 that receives the distal portion of the retracting case 62, and a distal portion 74 that defines at least one fluid port positioned in fluid communication with the central bore 72. In these aspects, the latching assembly 52 can be coupled to the latch body and configured for movement about and between a retracted position and a deployed position, and the valve assembly 56 (fluid control element) can be coupled to the retracting case 62 and positioned within the central bore 72 of the latch body 70. It is contemplated that the valve assembly 56 can be configured for axial movement about and between a closed position and an open position. In the closed position, the valve assembly 56 can prevent fluid flow between the proximal and distal portions of the latch body 70, while in the open position, the valve assembly 56 can permit fluid flow between the proximal and distal portions of the latch body 70. In further aspects, it is contemplated that axial movement of the retracting case 62 in a distal direction relative to the latch body 70 can be configured to move the latching assembly 52 of the head subassembly 50 from the retracted position toward the deployed position and to move the valve assembly 56 from the closed position toward the open position. Optionally, the latch body can comprise a proximal extension 76 as is known in the art.

In exemplary aspects, the valve assembly 56 can comprise a valve piston 57 that is configured for receipt within and axial movement relative to an indicator bushing 65. In these aspects, it is contemplated that the valve piston 57 can be configured to form a fluid-tight seal with the bushing during tripping (pump-in and pump-out) of the drilling assembly. It is further contemplated that the valve piston 57 will only advance distally of the bushing to the open position upon landing and then latching of the latch assembly 52 of the head subassembly 50. Thus, in use, the valve assembly 56 off the head subassembly can provide a latch indication "signal" based on the change in fluid flow through the head subassembly and the corresponding pressure change that is observable by the drilling operator. In further aspects, it is contemplated that the latch assembly 52, and thus, the valve piston 57, will remain in their respective latched and open positions until there is sufficient back pressure to effect radial inward movement of the latch assembly 52 to the retracted position, at which point the valve piston is returned to the closed position. It is contemplated that the disclosed coupling between the latch assembly 52 and the valve assembly 56 of the head subassembly 50 can avoid situations in which latches are deployed prematurely.

In further exemplary aspects, the head subassembly does not comprise a lip seal. Instead, following locking engagement between the overshot subassembly and the head subassembly, the lip seals of the overshot subassembly permit fluid-driven movement of the drilling assembly 10.

In use, upon entry of the sleeve 43 of the overshot subassembly 20 into the receptacle 60 of the head subassembly 50, it is contemplated that the inner surface of the retracting case and/or the proximal end of the head subassembly can be configured to force the at least one latch member 27 into the retracted position (from the deployed position) to accommodate the distal portion 24 of the overshot within the head subassembly 50. In further exemplary aspects, the at least one groove 61 can be configured to securely receive the at least one latch member 27 of the overshot subassembly 20 when the at least one latch member is positioned in the deployed position. In still further exemplary aspects, it is contemplated that the proximal end of the head subassembly can be configured to about a portion of the overshot subassembly 20 when the at least one latch member 27 is received within the at least one groove 61 defined within the receptacle 60 of the retracting case 62.

Upon movement of the sleeve 43 in a proximal direction (opposed to the first, distal direction) and substantially parallel to the longitudinal axis (such that the first driving surface 37 of the wedge portion of the driving element 36 is disengaged from the at least one latch member 27), the at least one latch member 27 can be retracted relative to the inner surface of the head subassembly such that the at least one latch member disengages the inner surface of the head subassembly.

The Secondary Overshot

Optionally, in exemplary aspects, and with reference to FIGS. 5 and 8, when retrieval of the drilling assembly 10 is not possible using reverse circulation methods, it is contemplated that a secondary overshot 200*a*, 200*b* can be used to retrieve the drilling assembly 10. In these aspects, the proximal portion 22 of the overshot subassembly 20 can define a receptacle 23 as disclosed herein. It is contemplated that the secondary overshot 200*a*, 200*b* can comprise a proximal portion 205 comprising a cable swivel assembly 250 and a distal portion 210 that is configured for complementary receipt within the receptacle 23 of the proximal portion 24 of the overshot subassembly 20. In use, the cable swivel assembly 250 can be any conventional swivel assembly that permits either permanent or selective connection of the secondary overshot 200*a*, 200*b* to a wireline cable. Optionally, as shown in FIG. 5, the distal portion 210 of the secondary overshot 200*a* can comprise a latch subassembly 212 that is configured for deployment to engage the proximal portion 22 of the overshot subassembly 20 (optionally, within receptacle 23). Alternatively, as shown in FIG. 8, the overshot subassembly 20 can comprise a spearhead 48 positioned at the proximal end of the overshot subassembly (e.g., within the receptacle 23), and the distal portion 210 of the secondary overshot 200*b* can comprise lifting dogs 216 that are configured to engage the spearhead 48 in the conventional manner. In further exemplary aspects, it is contemplated that the secondary overshot 200*a* can comprise a check valve assembly 220 and a valve seat 230 of the same design as those provided in overshot subassembly 20. In still further exemplary aspects, the secondary overshot 200*a*, 200*b* can comprise a sealing assembly 240. In these aspects, in contrast to the seal assembly 44 of overshot subassembly 20, the sealing assembly 240 can comprise a plurality of lip seals that are oriented in the same direction.

Methods

In use, a reverse-circulation drilling method can comprise positioning the distal portion of the overshot subassembly within the receptacle of the head subassembly. In another aspect, the method can comprise deploying the latch assembly of the overshot subassembly to engage the head subassembly. In a further aspect, the method can comprise using pressurized fluid to direct movement of the drilling assembly in a distal direction. In another aspect, the method can comprise continuing to direct movement of the drilling assembly in the distal direction until the latch assembly of the head subassembly is positioned in the deployed position and the check valve assembly of the overshot subassembly and the valve assembly of the head subassembly are positioned in the open position. In yet another aspect, the method can further comprise using pressurized fluid to direct movement of the drilling assembly in a proximal direction.

In exemplary aspects, the latch assembly of the distal portion of the overshot subassembly is deployed to engage the head subassembly before the drilling assembly is positioned within the borehole.

In additional aspects, the method can comprise retrieving the drilling assembly from the borehole. After retrieval of the drilling assembly, the method can further comprise disengaging the overshot subassembly from the head subassembly. Optionally, after disengagement of the overshot subassembly, the head subassembly can be used in a second drilling operation in which the head assembly is advanced within the borehole. At the completion of the second drilling operation, it is contemplated that the head subassembly can be retrieved using a wireline cable or, alternatively, using pressurized fluid in a reverse circulation process with an overshot subassembly as disclosed herein. If the head subassembly is expected to be retrieved using a wireline cable and performs the second drilling operation without the overshot subassembly, then it is contemplated that the head subassembly can be provided with a pressure seal (e.g., a lip seal) to permit distal advancement of the head subassembly using pressurized fluid.

Optionally, when reverse circulation methods are successful, the drilling assembly is retrieved from the borehole without the use of a wireline cable. Alternatively, if the pressurized fluid is unable to direct sufficient movement of the drilling assembly in a proximal direction to permit retrieval of the drilling assembly, the method can further comprise advancing the secondary overshot within the borehole in a distal direction to engage a portion of the overshot subassembly of the drilling assembly. In these aspects, the method can further comprise retrieving the secondary overshot and the drilling assembly. Optionally, the secondary overshot can be advanced within the borehole using a wireline cable. Optionally, in exemplary aspects, when the overshot subassembly of the drilling assembly comprises a spearhead, the secondary overshot can comprise lifting dogs that are configured to engage the spearhead to permit retrieval of the drilling assembly. Optionally, in further exemplary aspects, when the proximal portion of the overshot subassembly of the drilling assembly defines a receptacle, the secondary overshot can be advanced within the borehole in the distal direction until a portion of the secondary overshot is received within the receptacle of the proximal portion of the overshot subassembly. Optionally, in these aspects, the secondary overshot can comprise a distal portion having a latch assembly that is moveable about and between a retracted position and a deployed position, and the latch assembly of the distal portion of the secondary overshot can be moved from the retracted position to the deployed position to engage the proximal portion of the head subassembly. In exemplary aspects, as further disclosed herein, the secondary overshot can comprise a cable swivel assembly.

EXEMPLARY ASPECTS

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A reverse-circulation drilling assembly having a longitudinal axis and comprising: an overshot subassembly having a proximal portion, a distal portion, and a check valve assembly positioned axially between the proximal and distal portions, wherein the distal portion comprises a latch assembly; and a head subassembly having a latch assembly, a valve assembly, and a proximal portion that defines a receptacle configured to receive a portion of the distal portion of the overshot subassembly, wherein the proximal portion of the head subassembly further comprises a latch retracting case that is configured for axial movement relative to the longitudinal axis to effect movement of the latch assembly about and between a retracted position and a deployed position in which the latch assembly engages an inner surface of a drill string, wherein the latch retracting case is coupled to the valve assembly and configured to effect movement of the valve assembly about and between a closed position and an open position that permits fluid flow through the head subassembly, wherein the latch assembly of the overshot subassembly is configured for movement from a retracted position to a deployed position to engage the proximal portion of the head subassembly when the distal portion of the overshot subassembly is received within the receptacle, and wherein the check valve assembly of the overshot subassembly is biased to the closed position and configured to move from the closed position to the open position upon landing of the drilling assembly within a borehole.

Aspect 2: The reverse-circulation drilling assembly of aspect 1, wherein the latch retracting case of the head subassembly is configured to effect movement of the check valve assembly to the open position when the latch assembly of the head subassembly is moved from the retracted position to the deployed position.

Aspect 3: The reverse-circulation drilling assembly of aspect 1 or aspect 2, wherein the head subassembly comprises a latch body defining a central bore, wherein the latch assembly of the head subassembly is positioned within the latch body.

Aspect 4: The reverse-circulation drilling assembly of any one of aspects 1-3, wherein the overshot subassembly further comprises a valve seat positioned axially between the proximal and distal portions of the overshot subassembly, wherein the valve seat defines a central bore.

Aspect 5: The reverse-circulation drilling assembly of any one of aspects 1-4, wherein the check valve assembly comprises: a ball at least partially received within the central bore of the valve seat; and a spring configured to bias the ball in a proximal direction toward the closed position, wherein in the closed position, the ball blocks fluid flow through the central bore of the valve seat.

Aspect 6: The reverse-circulation drilling assembly of aspect 5, wherein the check valve assembly further comprises a bushing that is positioned axially between the valve seat and the spring, wherein in the closed position, the ball forms a fluid-tight seal with the bushing, and wherein in the open position, the ball is positioned distally of the bushing to permit fluid flow between the ball and the bushing.

Aspect 7: The reverse-circulation drilling assembly of any one of aspects 1-6, wherein the overshot subassembly comprises a seal assembly that circumferentially surrounds an outer surface of the valve seat and is axially positioned between the proximal and distal portions of the overshot subassembly.

Aspect 8: The reverse-circulation drilling assembly of aspect 7, wherein the seal assembly comprises first and second lip seals positioned adjacent each other and oriented in opposition to one another to permit axial movement of the drilling assembly by fluid flow in both distal and proximal directions.

Aspect 9: The reverse-circulation drilling assembly of any one of the preceding aspects, wherein the reverse-circulation drilling assembly does not comprise a holdback brake.

Aspect 10: The reverse-circulation drilling assembly of any one of the preceding aspects, wherein the head subassembly does not comprise a lip seal.

Aspect 11: The reverse-circulation drilling assembly of any one of aspects 3-10, wherein the latch body comprises a distal end portion, and wherein the head subassembly further comprises a spindle secured to the distal end portion of the latch body.

Aspect 12: The reverse-circulation drilling assembly of aspect 11, wherein the spindle does not comprise a central axial bore.

Aspect 13: The reverse-circulation drilling assembly of any one of the preceding aspects, wherein the proximal portion of the overshot subassembly defines a receptacle that is configured to receive a portion of an overshot.

Aspect 14: The reverse-circulation drilling assembly of any one of the preceding claims, wherein the proximal portion of the overshot subassembly comprises a spearhead assembly.

Aspect 15: The reverse-circulation drilling assembly of any one of the preceding aspects, wherein the latch assembly of the overshot subassembly comprises a plurality of latch members, and wherein the receptacle of the proximal portion of the head subassembly defines a groove that is configured to receive a portion of the latch members when the latch assembly is in the deployed position.

Aspect 16: A method of using the reverse-circulation drilling assembly of any one of the preceding aspects, the drilling assembly positioned within a borehole, the method comprising: positioning the distal portion of the overshot subassembly within the receptacle of the head subassembly; deploying the latch assembly of the overshot subassembly to engage the head subassembly; using pressurized fluid to direct movement of the drilling assembly in a distal direction; continuing to direct movement of the drilling assembly in the distal direction until the latch assembly of the head subassembly is positioned in the deployed position and the check valve assembly of the overshot subassembly and the valve assembly of the head subassembly are positioned in the open position; and using pressurized fluid to direct movement of the drilling assembly in a proximal direction.

Aspect 17: The method of aspect 16, wherein the latch assembly of the distal portion of the overshot subassembly is deployed to engage the head subassembly before the drilling assembly is positioned within the borehole.

Aspect 18: The method of any one of aspects 15-17, further comprising retrieving the drilling assembly from the borehole.

Aspect 19: The method of aspect 18, wherein the drilling assembly is retrieved from the borehole without the use of a wireline cable.

Aspect 20: The method of any one of aspects 18-19, further comprising, after retrieval of the drilling assembly: assembly: disengaging the overshot subassembly from the head subassembly; advancing the head assembly within the borehole; and retrieving the head assembly using a wireline cable.

Aspect 21: The method of any one of aspects 15-17, wherein if the pressurized fluid is unable to direct sufficient movement of the drilling assembly in a proximal direction to permit retrieval of the drilling assembly, the method further comprises: advancing a secondary overshot within the borehole in a distal direction to engage a portion of the overshot subassembly of the drilling assembly; and retrieving the secondary overshot and the drilling assembly.

Aspect 22: The method of aspect 21, wherein the secondary overshot is advanced within the borehole using a wireline cable.

Aspect 23: The method of aspect 21 or aspect 22, wherein the overshot subassembly of the drilling assembly comprises a spearhead, and wherein the secondary overshot comprises lifting dogs that are configured to engage the spearhead to permit retrieval of the drilling assembly.

Aspect 24: The method of aspect 21 or aspect 22, wherein the proximal portion of the overshot subassembly of the drilling assembly defines a receptacle, and wherein the secondary overshot is advanced within the borehole in the distal direction until a portion of the secondary overshot is received within the receptacle of the proximal portion of the overshot subassembly.

Aspect 25: The method of aspect 24, wherein the secondary overshot comprises a distal portion having a latch assembly that is moveable about and between a retracted position and a deployed position, wherein the latch assembly of the distal portion of the secondary overshot is moved from the retracted position to the deployed position to engage the proximal portion of the head subassembly.

Aspect 26: The method of aspect 24 or aspect 25, wherein the secondary overshot further comprises a cable swivel assembly.

Aspect 27: A reverse-circulation drilling assembly having a longitudinal axis and comprising: an overshot subassembly having: a proximal body portion defining a fluid port; a distal body portion having a wall with an inner surface and an outer surface, the inner surface of the distal body portion defining a central bore, the wall of the distal body portion defining a fluid port that extends from the inner surface to the outer surface; a valve assembly positioned in fluid communication with the fluid port of the proximal body portion and configured for axial movement about and between a closed position and an open position, wherein in the closed position, the valve assembly prevents fluid flow between the fluid port of the proximal body portion and the fluid port of the distal body portion, and wherein in the open position, the valve assembly permits fluid flow between the fluid port of the proximal body portion and the fluid port of the distal body portion, wherein the valve assembly is biased to the closed position; a driving element at least partially received within the central bore of the distal body portion, wherein the driving element has an outer surface; and an overshot latching assembly coupled to the distal body portion and configured for movement about and between a retracted position and a deployed position, wherein axial advancement of the distal body portion in a proximal direction relative to the driving element is configured to move the overshot latching assembly from its deployed position toward its retracted position; and a head subassembly having: a retracting case having an inner surface, a proximal portion that defines a central bore and a groove, and a distal portion that defines a driving surface, wherein the central bore is configured to receive a portion of the distal body portion of the overshot subassembly, and wherein the groove of the proximal portion of the body is configured to receive a portion of the overshot latching assembly when the overshot latching assembly is in the deployed position; a latch body having a central bore, a proximal portion that receives the distal portion of the retracting case, and a distal portion that defines at least one fluid port positioned in fluid communication with the central bore; a head latching assembly coupled to the latch body and configured for movement about and between a retracted position and a deployed position, a fluid control element coupled to the retracting case and positioned within the central bore of the latch body, wherein the fluid control element is configured for axial movement about and between a closed position and an open position, wherein in the closed position, the fluid control element prevents fluid flow between the proximal and distal portions of the latch body, and wherein in the open position, the fluid control element permits fluid flow between the proximal and distal portions of the latch body, wherein axial movement of the retracting case in a distal direction relative to the latch body is configured to move the head latching assembly from the retracted position toward the deployed position and to move the fluid control element from the closed position toward the open position.

Aspect 28: An overshot assembly comprising: a proximal portion defining a receptacle; and a distal portion comprising a latch subassembly that is configured for deployment to engage a proximal portion of a head subassembly, wherein the receptacle of the proximal portion of the overshot assembly is configured to complementarily receive a latch subassembly of a distal portion of a second overshot assembly.

Aspect 29: An overshot system comprising: a first overshot assembly comprising: a proximal portion defining a receptacle; and a distal portion comprising a latch subassembly that is configured for deployment to engage a proximal portion of a head assembly; and a second overshot assembly comprising: a proximal portion comprising a cable swivel assembly; and a distal portion that is configured for complementary receipt within the receptacle of the proximal portion of the first overshot subassembly, and wherein the distal portion of the second overshot assembly comprises a latch subassembly that is configured for deployment to engage the proximal portion of the first overshot assembly.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. An overshot system comprising:

a first overshot assembly comprising:

a proximal portion defining a receptacle;

a distal portion comprising a latch subassembly that is configured for deployment to engage a proximal portion of a head assembly; and a check valve assembly positioned axially between the proximal and distal portions of the first overshot assembly; and a second overshot assembly comprising:

a proximal portion comprising a cable swivel assembly; and a distal portion that is configured for complementary receipt within the receptacle of the proximal portion of the first overshot subassembly, and wherein the distal portion of the second overshot assembly comprises a latch subassembly that is configured for deployment to engage the proximal portion of the first overshot assembly.

2. The overshot system of claim 1, wherein the check valve assembly of the first overshot assembly comprises a valve seat positioned axially between the proximal and distal portions of the first overshot assembly, wherein the valve seat defines a central bore.

3. The overshot system of claim 2, wherein the check valve assembly comprises:

a ball at least partially received within the central bore of the valve seat; and a spring configured to bias the ball in a proximal direction toward a closed position, wherein in the closed position, the ball blocks fluid flow through the central bore of the valve seat.

4. The overshot system of claim 3, wherein the check valve assembly further comprises a bushing that is positioned axially between the valve seat and the spring, wherein in the closed position, the ball forms a fluid-tight seal with the bushing, and wherein in an open position, the ball is positioned distally of the bushing to permit fluid flow between the ball and the bushing.

5. The overshot system of claim 2, wherein the first overshot assembly comprises a seal assembly that circumferentially surrounds an outer surface of the valve seat and is axially positioned between the proximal and distal portions of the first overshot assembly.

6. The overshot system of claim 5, wherein the seal assembly comprises first and second lip seals positioned adjacent each other and oriented in opposition to one another to permit axial movement of the overshot system by fluid flow in both distal and proximal directions.

7. The overshot system of claim 1, wherein the latch subassembly of the first overshot assembly comprises a plurality of latch members.

8. The overshot system of claim 1, wherein the latch subassembly of the first overshot assembly comprises a plurality of latch members.

9. An overshot system comprising:

a first overshot assembly comprising:

a proximal portion comprising a spearhead; and a distal portion comprising a latch subassembly that is configured for deployment to engage a proximal portion of a head assembly; and a second overshot assembly comprising:

a proximal portion comprising a cable swivel assembly; and a distal portion comprising lifting dogs that are configured to engage the spearhead of the proximal portion of the first overshot assembly.

10. The overshot system of claim 9, wherein the first overshot assembly comprises a check valve assembly positioned axially between the proximal and distal portions.

11. The overshot system of claim 10, wherein the check valve assembly of the first overshot assembly comprises a valve seat positioned axially between the proximal and distal portions of the first overshot assembly, wherein the valve seat defines a central bore.

12. The overshot system of claim 11, wherein the check valve assembly comprises:

a ball at least partially received within the central bore of the valve seat; and a spring configured to bias the ball in a proximal direction toward a closed position, wherein in the closed position, the ball blocks fluid flow through the central bore of the valve seat.

13. The overshot system of claim 12, wherein the check valve assembly further comprises a bushing that is positioned axially between the valve seat and the spring, wherein in the closed position, the ball forms a fluid-tight seal with the bushing, and wherein in an open position, the ball is positioned distally of the bushing to permit fluid flow between the ball and the bushing.

14. The overshot system of claim 11, wherein the first overshot assembly comprises a seal assembly that circumferentially surrounds an outer surface of the valve seat and is axially positioned between the proximal and distal portions of the first overshot assembly.

15. The overshot system of claim 14, wherein the seal assembly comprises first and second lip seals positioned adjacent each other and oriented in opposition to one another to permit axial movement of the overshot system by fluid flow in both distal and proximal directions.

16. An overshot system comprising:

a first overshot assembly comprising:

a proximal portion defining a receptacle;

a distal portion comprising a latch subassembly that is configured for deployment to engage a proximal portion of a head assembly; and a valve seat positioned axially between the proximal and distal portions of the first overshot assembly, wherein the valve seat defines a central bore; and a second overshot assembly comprising:

a proximal portion comprising a cable swivel assembly; and a distal portion that is configured for complementary receipt within the receptacle of the proximal portion of the first overshot subassembly, and wherein the distal portion of the second overshot assembly comprises a latch subassembly that is configured for deployment to engage the proximal portion of the first overshot assembly.

17. The overshot system of claim 16, further comprising:

a ball at least partially received within the central bore of the valve seat; and a spring configured to bias the ball in a proximal direction toward a closed position, wherein in the closed position, the ball blocks fluid flow through the central bore of the valve seat.

18. The overshot system of claim 17, further comprising a bushing that is positioned axially between the valve seat and the spring, wherein in the closed position, the ball forms a fluid-tight seal with the bushing, and wherein in an open position, the ball is positioned distally of the bushing to permit fluid flow between the ball and the bushing.

19. The overshot system of claim 16, wherein the first overshot assembly comprises a seal assembly that circumferentially surrounds an outer surface of the valve seat and is axially positioned between the proximal and distal portions of the first overshot assembly.

* * * * *